US011154966B1

(12) United States Patent
Del Giudice

(10) Patent No.: US 11,154,966 B1
(45) Date of Patent: Oct. 26, 2021

(54) MULTIPLE USE OPEN-END WRENCH

(71) Applicant: John Del Giudice, Calverton, NY (US)

(72) Inventor: John Del Giudice, Calverton, NY (US)

( * ) Notice: Subject to any disclaimer, the term of this patent is extended or adjusted under 35 U.S.C. 154(b) by 0 days.

(21) Appl. No.: 17/335,225

(22) Filed: Jun. 1, 2021

Related U.S. Application Data

(60) Provisional application No. 63/132,546, filed on Dec. 31, 2020.

(51) Int. Cl.
*B25B 13/08* (2006.01)
*B25G 1/10* (2006.01)

(52) U.S. Cl.
CPC ..... *B25B 13/08* (2013.01); *B25G 1/102* (2013.01)

(58) Field of Classification Search
CPC ..... B25B 13/08; B25G 1/102
See application file for complete search history.

(56) References Cited

U.S. PATENT DOCUMENTS 529,707 A * 11/1894 Clay ..... B25B 13/06 81/437
562,611 A * 6/1896 Hummel et al. ..... B25B 13/08 81/119
1,297,846 A * 3/1919 Herrman ..... B25B 13/08 81/125.1
1,479,772 A * 1/1924 Cook ..... B25B 13/08 81/119
1,550,564 A * 8/1925 Yashuhiko ..... B25B 13/107 81/185
1,624,508 A * 4/1927 Reilly ..... B25B 13/08 81/125.1
1,640,383 A * 8/1927 Thomas ..... B25B 13/04 81/176.15
D120,489 S * 5/1940 Musselman ..... D8/17
D167,245 S * 7/1952 Anderson ..... D8/28
2,705,433 A * 4/1955 Goldman ..... B25B 13/56 81/125.1
2,716,367 A * 8/1955 Montgomery ..... B25B 13/04 81/124.3
2,803,158 A * 8/1957 King ..... B25B 13/12 81/77
2,900,857 A * 8/1959 Burnette ..... B25B 13/08 81/185
3,738,203 A * 6/1973 Cudd ..... B25B 13/107 81/185
3,858,464 A * 1/1975 Evans ..... B25B 13/08 81/119

(Continued)

OTHER PUBLICATIONS

Cross Reference Chart http://www.dansmc.com/wrench_referance.jpg (Jul. 6, 2016) (Year: 2016).*

*Primary Examiner* — David B. Thomas
(74) *Attorney, Agent, or Firm* — John F. Vodopia

(57) ABSTRACT

The invention provides a multiple use open-end wrench with an elongate handle having a proximal end, an opposing distal end and a longitudinal axis extending therebetween, and a first wrenching head arranged at the proximal end of the elongated handle formed with an opening for receiving and turning a plurality of varying sized fasteners. The opening is formed by opposing left and right jaws with opposing parallel left and right jaw surfaces, the opening having a fixed length L in the aggregate that extends from an end tip of the proximal end substantially in parallel with the opposing parallel jaw surfaces.

11 Claims, 7 Drawing Sheets

(56) References Cited

U.S. PATENT DOCUMENTS

| | | | | | |
|---|---|---|---|---|---|
| 3,931,749 | A * | 1/1976 | Evans | B25B 13/08 | 81/119 |
| 5,259,281 | A * | 11/1993 | Burke | B25B 13/04 | 7/138 |
| 5,313,860 | A * | 5/1994 | Liou | B25F 1/04 | 7/138 |
| D356,240 | S * | 3/1995 | Meldahl | D8/105 | |
| D393,578 | S * | 4/1998 | Keddie | 81/124.4 | |
| D402,515 | S * | 12/1998 | McIntyre | D8/17 | |
| 5,931,063 | A * | 8/1999 | Kuo | B25B 23/0035 | 81/119 |
| D422,467 | S * | 4/2000 | Mollack | D8/28 | |
| 6,131,492 | A * | 10/2000 | Mai | B25B 13/04 | 81/119 |
| D434,621 | S * | 12/2000 | Tonkin | D8/17 | |
| D448,981 | S * | 10/2001 | Solanki | D8/17 | |
| 6,343,529 | B1 * | 2/2002 | Pool | B25B 9/00 | 81/13 |
| D462,245 | S * | 9/2002 | Friedman | B25B 13/06 | D8/21 |
| 6,523,440 | B2 * | 2/2003 | Friedman | B25B 13/04 | 81/119 |
| 9,452,511 | B2 * | 9/2016 | Nguyen | B25B 13/50 | |
| D786,640 | S * | 5/2017 | Hilman | D8/27 | |
| 2002/0078799 | A1 * | 6/2002 | Friedman | B25B 13/08 | 81/125.1 |

* cited by examiner

MULTIPLE USE OPEN-END WRENCH

CROSS-REFERENCE TO RELATED APPLICATIONS

This application derives the benefit of the filing date of U.S. Provisional Patent Application No. 63/132,546, filed Dec. 31, 2020. The contents of the provisional application are incorporated by reference in this application.

BACKGROUND OF THE INVENTION

Technical Field

This disclosure relates to the field of hand-held tools and, more particularly, to a multiple use open-end wrench with at least one wrenching head, the wrenching head formed with an opening comprising a plurality of differing sized opening portions, each of which being adapted for receiving, holding and turning a differing sized fastener, and where the sizes of the opening portions decrease in graduated fashion as a function of the distance of the respective opening portions away from end tips of the opposing jaw surfaces, to accommodate appropriately sized fasteners.

Discussion of Related Art

Consumers have been using or purchasing tools for thousands of years. Many of these tools, such as drills, hammers, screwdrivers and wrenches are not necessarily used on a daily basis, or may be infrequently used at all. Nonetheless, tools of such nature are considered must-have tools for homeowners, appear in many American households, and serve their respectively intended purposes.

Various tools may be used for tightening bolts, nuts, or screws, as an example. In the art, it is necessary to possess multiple individual wrenches to perform various sizes of work. Decreasing the number of tools and increasing efficiency of tools is desirable to consumers. Tools, and, more particularly, wrenches with interchangeable head and end portions are not uncommon in the art. A tool with a body that converts a wrench to a screw-driver, or vice-versa, as an example, are taught in the art. However, tools taught in the art often contain more than one part or piece.

Thus, consistent with the goal of decreasing the number of tools and increasing efficiency of tools, an open-end wrench with a plurality of grooves on its wrenching heads may enable consumers to replace a plurality of standard combination wrenches with an individual tool.

SUMMARY OF THE INVENTION

In accordance with an aspect of the disclosure, an open-end wrench includes an elongated handle. The elongated handle comprises a proximal end and an opposing distal end. The elongated handle has a longitudinal axis extending between the proximal and distal ends. At at least one of the proximal and distal ends, and preferably, at both the proximal and distal ends, is positioned a wrenching head.

The wrenching head(s) include(s) an opening formed between opposing surfaces of a first stationary jaw and a second stationary jaw. The opening comprises multiple graduated opening portions, for example, three (3), a first largest opening portion, a second smaller opening portion contiguous to or with the first largest opening portion and a third smallest opening portion contiguous to or with the second smaller opening portion, moving inwards and away from the outermost extents or tips of the opposing jaw surfaces. Each opening portion is defined with a depth; the opposing jaw surfaces in any of the three (3) opening portions are parallel, and equal in length.

In one embodiment, the inventive multiple use open-end wrench comprises only a single wrenching head at the proximal end, where the wrenching head has an opening comprising three (3) opening portions. The wrench and wrenching head so configured enables the wrenching head to receive (and the wrench turn) 3 different sized fasteners. The largest of the three (3) opening portions seats a first and largest sized fastener, of the three (3) different sized fasteners, and allows the second smaller and third smallest sized fasteners to pass through the first opening portion. The second opening portion is sized to seat the second smaller-sized fasteners, where the third smallest sized fastener would pass through the first and second opening portions, and seat in the third smallest sized opening portion. The third smallest sized opening portion is sized to receive the third and smallest sized fastener. Turning the wrench turns the wrenching head and the fastener received and seated in the respectively-sized opening portion.

Where the wrenching head opening comprises three (3) opening portions, the sum of the three (3) separate depths (including opening portion jaw surfaces and any transitions, depending on the intended fasteners) is equal the aggregate depth D of the opening. It should be noted that the dimensions of the opening portions must be slightly larger than the actual dimensions of the hex fasteners, in order to fit, for example, 1 to 5%, preferably 2%. If the surfaces of the fasteners and the jaw surfaces of the opening portions were exactly the same size, it would be problematic to seat the fasteners.

A separation between the equal and parallel surfaces of the first and the second stationary jaw surfaces (and transitions where the fasteners are hexagonal fasteners), in each of the three (3) opening portions, is fixed, defining the sizes of the three (3) graduated smaller opening portions (moving in from the outermost tips of the jaws of the wrenching head). If the fastener is square, the depth of the respective opening portions (which are some part of the aggregate depth D of the entire opening) and the separation between the first and second parallel jaw surfaces for each respective opening portions are equal to the respective depths.

However, if the fasteners to be seated in the respective opening portions of the wrenching head are hexagonal fasteners, which are shaped as regular polygons, the depths of the respective opening portions are not simply calculated. The depths associated with each opening portion adapted for each hex fastener includes must include the length of the side of each fastener plus a vertical component of the transition between opening portions. The transition includes a vertical and horizontal component embodying legs of a right triangle, where the length of the transition is the hypotenuse of the right triangle (see FIG. 6). The minimal transition includes a minimal vertical component and minimal horizontal component, which are the differences between the vertical and horizontal components of the right triangles formed by bisecting one of the equilateral triangles of the respective larger and smaller opening portions (hex fasteners). From these differences, the hypotenuse of minimum length of the transition is calculated, which should be sufficient to support gripping effectively to turn the hex fasteners contacted by the wrench head on the opposing parallel sides and the opposing lower transitions.

The last or smallest opening portion must have a transition equivalent to the length of the jaw surfaces (slightly larger than the length of the side S of the hexagonal fastener), plus the vertical component of the side ending at the lowest point of the hex fastener when seated. This is S×sin 30, or ½ S. For that matter, for each opening portion, the distance between the parallel sides is approximately equal to 2×S×cos 30 degrees or $2\times(3^{1/2})/2\times S$, where S is the length of the sides of the hex surfaces; this is $(3^{1/2})\times S$. Please note that the length of the respective jaw surfaces for each opening portion must be slightly larger than the length of the corresponding hex nut fastener surfaces, and the distance between the jaw surfaces in each opening portion must be slightly larger than $(3^{1/2})\times S$ of the hex fastener surface in order to readily accommodate each respective hex nut in each respective opening portion.

For example, if the first largest hex fastener is identified as ¾" hex fastener, the opposing sides are ⅝ inch. Then, the distance between the ⅝ inch parallel sides is 2×adjacent side of the right triangles formed by bisecting the two opposing equilateral triangles defining the parallel sides. This is 2×cos 30×hypotenuse. The hypotenuse is the length of the parallel sides, or S. Hence, the distance is 2×cos 30×S, or S×square root 3. When S is ⅝ inch, the distance between the sides (and the jaws plus about 2% to accommodate the hex nuts therein) is $3(3^{1/2})/8$. Half the distance between parallel side of the ¾ inch hex nut with ⅝ inch sides is $3/16\times3^{1/2}$.

For the second smaller hex fastener, which is ⅝ inch, the length of the opposing hex surfaces are approximately 9/16 inch, and the distance between the 9/16 inch sides is 2×cos 30×hypotenuse (or 9/16), or 9/16 square root 3. Half the distance is $9/32\times3^{1/2}$.

For the third smallest hex fastener, which is ½ inch, the opposing sides are 7/16 inch, and the distance between the 7/16 inch sides is cos 30×hypotenuse (7/16)×2, or 7/16 square root 3. Half the distance is $7/32\times3^{1/2}$.

It follows that the minimal transition between opening portions for the ¾ inch fastener and the ⅝ inch fasteners forms a proportional right triangle. The transition is the hypotenuse of the right triangle where the horizontal component is the difference between the distances between the opposing surfaces of the ¾ inch and ⅝ inch fasteners, or ⅝-½, or ⅛ inch. The hypotenuse is adjacent over cosine 30, or $1/8/(3^{1/2})/2$, or $1/(4\times(3^{1/2}))$. With the hypotenuse and the horizontal component known, the vertical component is then sin 30°×hypotenuse, or $1/32\ (3^{1/2})$.

The inventive multiple use open-ended wrench preferably includes a second wrenching head, configured to receive and turn three differently sized fasteners, such as hex nuts. In an exemplary embodiment, the first wrenching head is arranged as in the first exemplary embodiment, as explained above, and the second wrenching end is configured to receive fasteners, for example, sized at 7/16 inch, ⅜ inch and 5/16 inch. The arrangement of the opening portions of the opening in the second wrenching head, to accommodate the 7/16, ⅜ and 5/16 inch fasteners follows the arrangement for the wrenching head described above.

Please note that while the exemplary embodiments described include three wrenching heads, at one or more of the proximal and distal ends, the invention is not limited thereto. The inventive wrench may have two, three, four, and five opening portions at each wrenching head without deviating from the scope and spirit of the invention.

BRIEF DESCRIPTION OF THE DRAWINGS

The accompanying drawings, which are incorporated in and constitute a part of this specification, illustrate aspects and features of the disclosure and, together with the detailed description below, serve to further explain the disclosure, in which.

DETAILED DESCRIPTION OF THE INVENTION

Descriptions of technical features or aspects of an exemplary embodiment of the disclosure should typically be considered as available and applicable to other similar features or aspects in another exemplary embodiment of the disclosure. Accordingly, technical features described herein according to one exemplary embodiment of the disclosure may be applicable to other exemplary embodiments of the disclosure, and thus duplicative descriptions may be omitted herein.

Exemplary embodiments of the disclosure will be described more fully below (e.g., with reference to the accompanying drawings). Descriptions of technical features or aspects of embodiments may be described using the United States customary units, which include, inter alia, inches. Please note, however, that while described in US imperial units, the inventive wrenches are not so limited, and may also be manufactured in metric unit sizes. Accordingly, the technical features or aspects of embodiments described herein should be interpreted to include both the US units and metric units, i.e., inches, centimeters, millimeters, without deviating from the scope and spirit of the invention.

Figure 1:
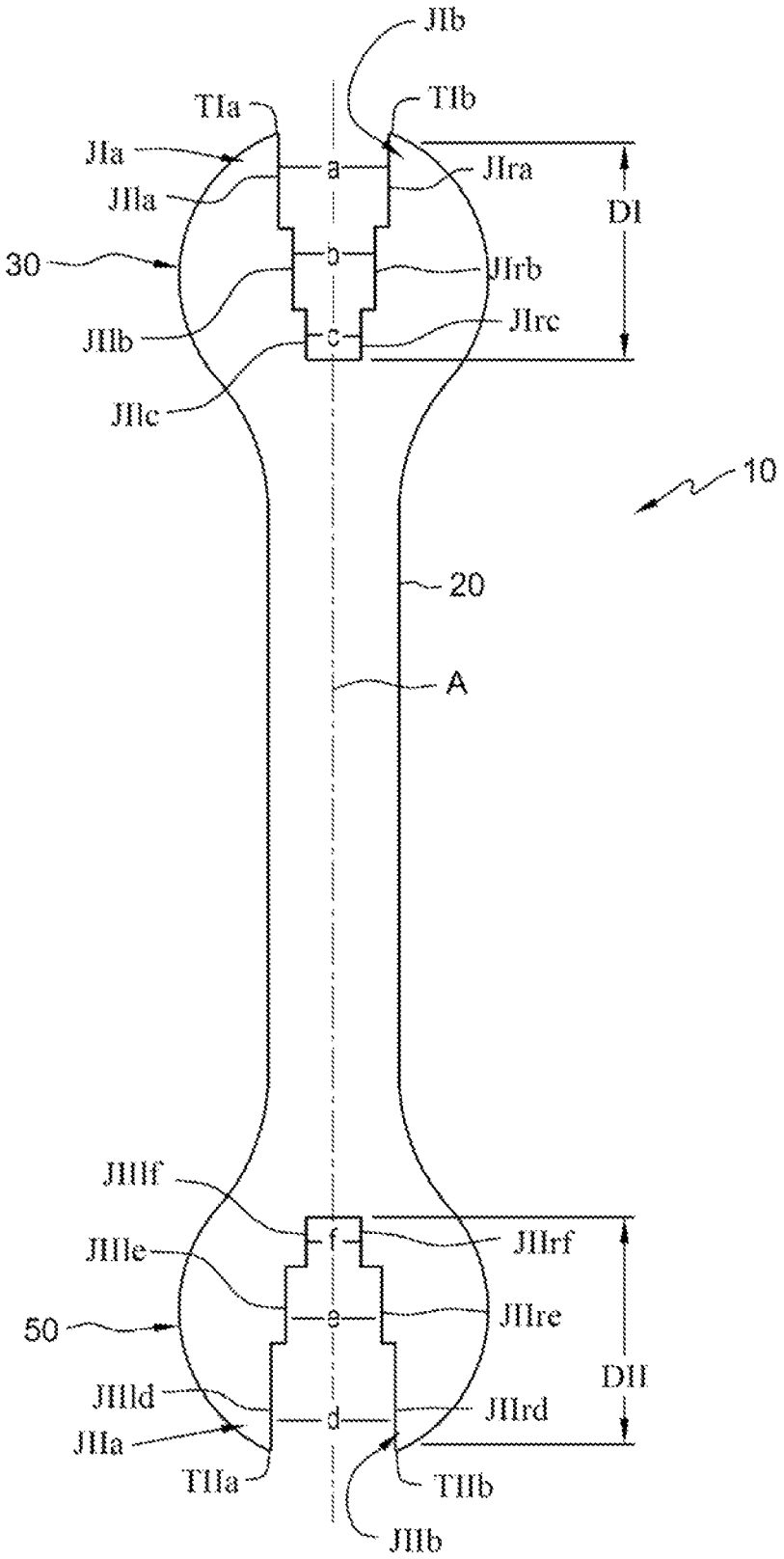
FIG. 1 is a plan view of a first embodiment of a multiple use, open-end wrench, constructed in accordance with the present disclosure.

FIG. 1 presents a first embodiment of the inventive multiple use, open-end wrench 10 for use with regular square fasteners, such as nuts, bolts, etc. Open-end wrench 10 includes an elongated handle 20 having a proximal end and a distal end. The elongated handle 20 has a longitudinal axis A, extending between the proximal and distal end. The proximal end is configured as a first, multiple use wrenching head 30, with an opening between first and second opposing stationary jaws JIa, JIb for receiving square fasteners for turning. The first opening extends from outermost tips TIa and TIb of the first and second opposing stationary jaws JIa, JIb (of the first multiple use wrenching head 30) for an aggregate depth DI, defining 3 decreasingly-sized opening portions. The 3 decreasingly-sized opening portions are adapted for use with three (3) different sized square nuts, such as but not limited to 9/16, ½ and 7/16 inches.

The distal end is configured as a second, multiple use wrenching head 50, with an opening between third JIIa and fourth JIIb opposing stationary jaws for receiving square fasteners for turning. The opening extends from outermost tips TIIa and TIIb of the first and second opposing stationary jaws JIIa, JIIb (of the second multiple use wrenching head 50) for an aggregate depth DII, defining 3, graduated, decreasingly sized opening portions. The 3 decreasingly-sized opening portions are adapted for use with three (3) different sized square fasteners, e.g., 3/8, 5/16, 1/4, 3/16 inches, etc., without limitation. Preferably, the sizes of the three opening portions of wrenching head 30 are different than those of wrenching head 50.

The first jaw opening portion is the largest in both wrenching heads 30, 50. For example, first wrenching head 30 is adapted to accommodate square nuts sized as 9/16 inch between opposing jaw set JIIa, JIra, 1/2 inch between opposing jaw set JIIb, JIrb) and 7/16 inch between opposing jaw set JIIc, JIrc, as shown. The 9/16 sized square nut, which is the largest, can only be seated in the first opening portion of wrenching head 30 defined by the first opposing jaw set JIIa, JIra, with jaw surfaces separated by 9/16 inch for a portion 9/16 inch portion of the aggregate 3/2 inch depth of D1. No larger square nut can be received in the first opening portion, but smaller sized square nuts can pass through. That is, smaller sized square nut fasteners, such as the 1/2 inch and 7/16 inch will not seat in the first opening portion because they are smaller than the 9/16 inch by 9/16 size of same. For example, a 1/2 inch square fastener will not seat in the first opening portion formed by 9/16 inch jaw set JIIa, JIra, but only in the second opening formed by second 1/2 inch jaw set JIIb, JIrb). The 1/2 inch square nut fastener cannot move further in past the second opening, which is 1/2 inch by 1/2 inch, into the third opening portion, because the distance between the jaw set JIIc, JIrc of the third opening surfaces is 7/16 inch, so the third opening is 7/16 inch by 7/16 inch square. Only a 7/16 inch square nut can seat properly in the third opening in the exemplary embodiment—can't get a B inch square nut in an opening adapted for a 7/16 inch square nut fastener.

The second, multiple use wrenching head 50 (as shown in FIG. 1) likewise includes three (3) jaw sets adapted for use with three (3) decreasingly smaller sized square nuts (3/8, 5/16 and 1/4 inches), accommodating square nut fasteners sized 3/8 inch (jaw set JIIId, JIIrd), 5/16 inch (jaw set JIIIe, JIIre) and 1/4 inch (jaw set JIIIf, JIIrf), as shown. The largest sized square nut (3/8 inch) can only be seated in the first opening portion formed by the first jaw set JIIId, JIIrd, which are 3/8 inch in depth and 3/8 inch therebetween. No larger fastener can be received therein, while smaller fasteners, such as the 5/16 inch, 1/4 inch and even smaller sized square nuts, (like 3/16, 1/8, 1/16, etc.) are smaller so can move past the 3/8 by 3/8 inch first opening, only a 3/8 inch square nut fastener will properly seat in the first 3/8 by 3/8 inch first opening portion of the first set of jaws of proximal head 30.

Likewise, the 5/16 inch fastener will not properly seat in the first opening portion of the first jaw set JIIId, JIIrd of the second wrenching head 50, but only in the second opening portion defined by the 5/16 inch depth or length, and 5/16 inch distance between the second jaw set surfaces JIIIe, JIIre. The 5/16 inch square nut fastener cannot move further in past the first 5/16 by 5/16 inch second opening portion, into the third opening portion formed by the third 1/4 inch jaw set (JIIIf, JIIrf), because the third opening is 1/4 inch by 1/4 inch. Moreover, the 1/4 inch×1/4 inch square nut fastener cannot be properly seated in the second 5/16 by 5/16 inch opening portion, as should be apparent.

Please note that while the FIG. 1 embodiment shows the inventive open-end wrench 10 formed with first and second wrenching heads 30, 50, each formed with three (3) respective jaw sets defining opening portions for receiving the three decreasing smaller sized square nut fasteners (sized 9/16, 1/2, and 7/16 inches), the inventive multiple use open-end wrench is not limited thereto. The inventive open-end wrench may be formed with wrenching heads comprising the same number, or different numbers of jaw sets, such as 2, 3, 4, 5, etc., on one end or differing numbers on respective ends, without deviating from the scope or spirit of the invention. For that matter, the three jaw sets in the exemplary embodiment is not limited to 9/16 inch, 1/2 inch, 7/16 inch, but could be any open-end wrench sizes, for example, 1 inch, 3/4 inch, 1/2 inch, or 1/ inch, 31/32 inch and 15/16 inch, or 1/10 inch, 3/40, 1/20, or 5/2 inch, 9/4 inch, 2 inches, 3 inches, 4 inches, 5 inches, 6 inches, etc., without deviating from the scope or spirit of the invention. The "a" "b," "c" and "d", "e" and "f" fasteners, in the FIG. 1 exemplary embodiment, for example, with the respective jaw sizes, are always largest to smallest, because the smaller sized nuts or bolt heads have to get past the first jaw surfaces defining the first largest opening portion, to get to the second, smaller opening portion or the third smallest opening portion.

The design of the double-sided wrench will/can have alternating sized openings on either end, for the purpose of balance, strength, and esthetics. In the example of metric sizing (millimeters), the wrench would have all of the odd sizes on one end of the wrench while even sizes would be on the other. Ex: 15 mm-13 mm-11 mm and 14 mm-12 mm-10 mm. In the sizes used by the Society of Automotive Engineers (SAE—inches), the same alternating design would occur, Ex: 3/4-9/16-7/16 and 5/8-1/2-3/8. Alternating, sequential sizes strengthen the openings, provide balance to the wrench in its entirety, and improves overall appearance. If the sizes of the openings were not alternated, then the openings on the wrench would be of minimal contrast to the next size and the wrench would be lopsided in appearance and actual weight, having the three largest openings on one side, and the three smallest openings on the other.

The multiple, differently-sized opening portions defined by the varying distances between the jaw set surface of the first wrenching head 30, and/or the second wrenching head 50, of FIG. 1, are suitable for engaging six (6) differently sized fasteners with a single inventive wrench 10. The differently-sized square nut fasteners, and the wrenches themselves may be formed of any material, such as stainless-steel, carbon steel, zinc or cadmium plated for purposes of corrosion resistance, without limitation. The inventive wrenches may turn any fasteners, including nuts, coupling nuts, finish nuts, jam nuts, heavy nuts, nylon jam nuts, nylon insert lock nuts, slotted nuts, structural heavy nuts, lag screws, cap bolts, tap bolts, cap screws, trim head cap screws, serrated flange bolts, machine bolts, and screw head bolts, not just square by hexagonal as well, as explained in greater detail below. In accordance with some embodiments, shaped fasteners also may include at least sheet metal screws, thread cutting machine screws, self-drilling SMS, lag bolts, and flange bolts.

Figure 2:
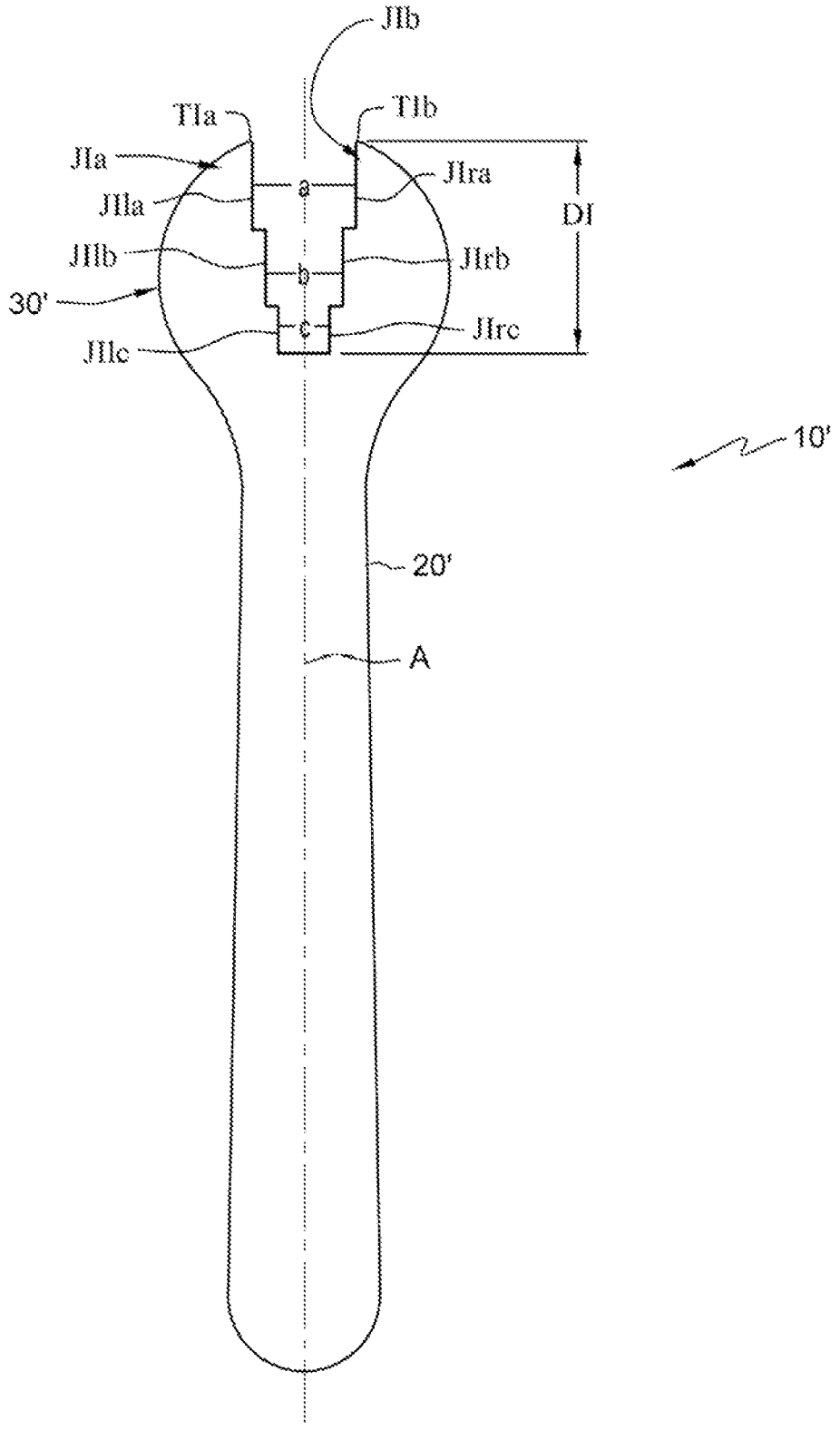
FIG. 2 is a plan view of an alternative embodiment of the FIG. 1 multiple use, open-end wrench.

For that matter, while wrench 10 is shown in FIG. 1 to include a second set of jaws at the distal end, the invention is not limited thereto. The wrench 10 is not required to have a second set of jaws at the distal end. FIG. 2 presents a multiple use open-end wrench 10' that includes only a first wrenching head 30', formed in accordance with the inventive principles, and a second distal end that has no second wrenching head.

Figure 3:
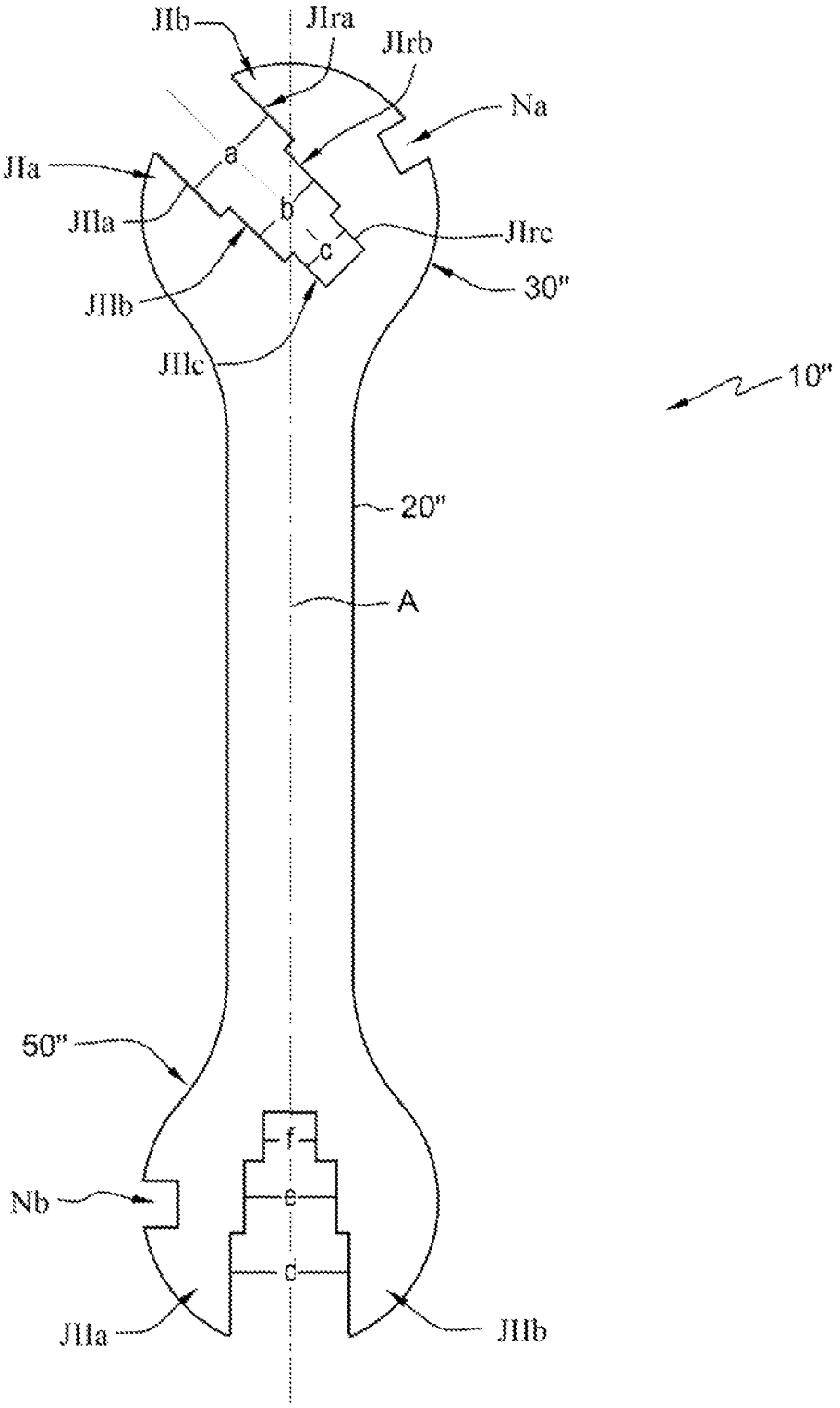
FIG. 3 is a plan view of an alternative embodiment of the FIG. 1 multiple use, open-end wrench.

FIG. 3 presents a third embodiment. As shown therein, an inventive multiple use open-end wrench 10" includes a first wrenching head 30" and a second wrenching head 50". As shown, the first wrenching head 30" is formed such that the 3 jaw set surfaces and opening portions and at an angle of about 30 degrees relative the line of central of axis A, to allow for easier handling to capture a square nut for seating in any of the three opening portions. First wrenching head 30" also includes a notch Na at a point along an outer surfaces of the first wrenching head 30"; second wrenching head 50" includes a notch Nb, as shown. The notch Na of the first wrenching head 30" and the notch Nb of the second wrenching head 50" are suitable for engaging shaped fasteners, for example, square fasteners (nuts, bolt heads, etc.), but are not limited thereto. The measurements of the notches Na and Nb should be interpreted to include both the corresponding conversion of United States customary units to the metric system units, which include, inter alia, centimeters and millimeters. For example, Na may be 7/16 inch and Nb may be 3/8 inch. The notches are suitable for engaging varying sized, and/or shaped fasteners, for example, pentagonal, hexagonal, octagonal, nonagonal, decagonal, etc.

Figure 4:
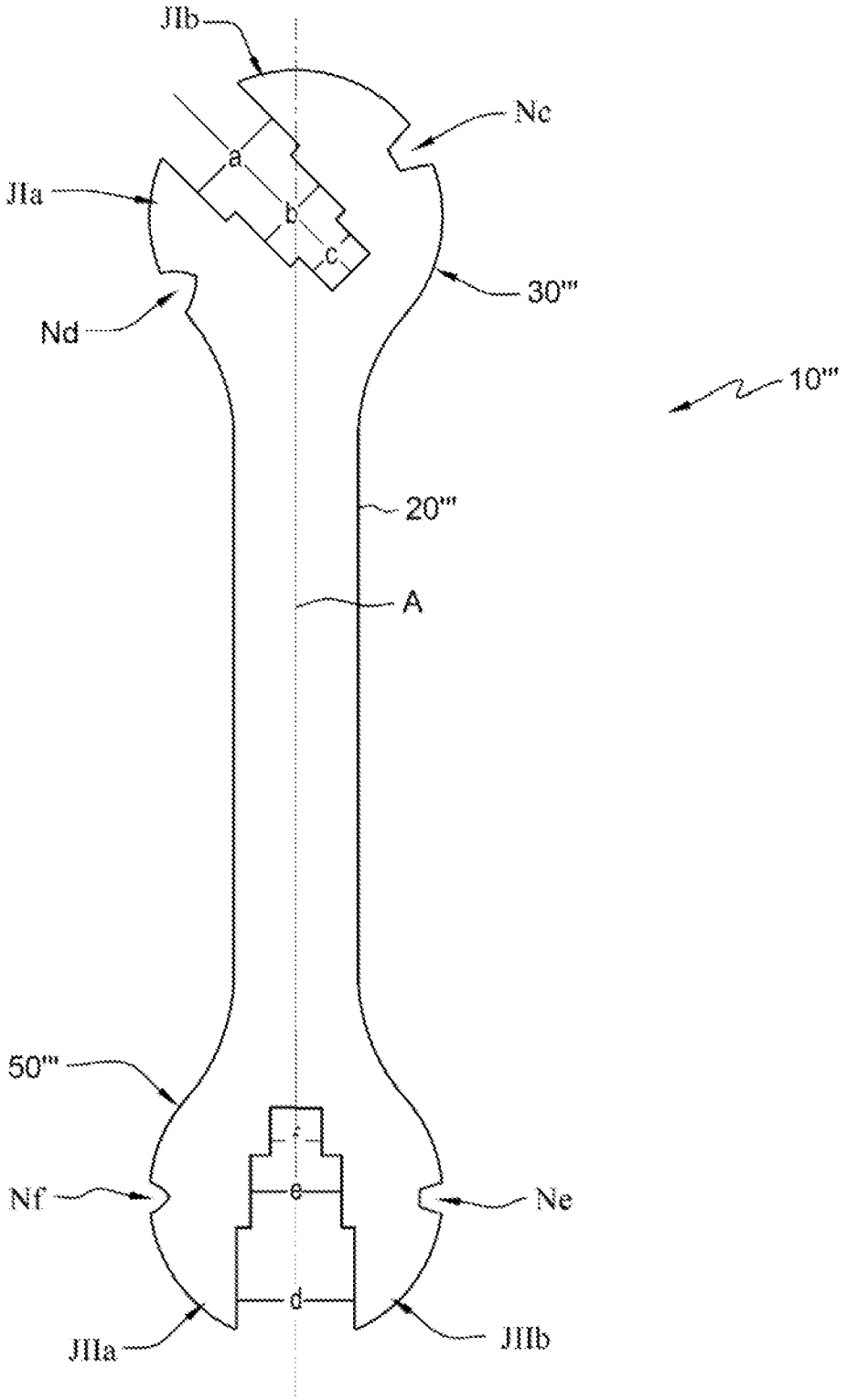
FIG. 4 is a plan view of an alternative embodiment of the FIG. 1 multiple use, open-end wrench.

FIG. 4 presents a fourth embodiment. As shown therein, an inventive multiple use open-end wrench 10''', which includes a first wrenching head 30''' and a second wrenching head 50''', each comprising notches Nc, Nd (30'''), and Ne and Nf(50''') at respective outer surfaces as shown. The notches are suitable for engaging shaped fasteners, for example, pentagonal, hexagonal, octagonal, nonagonal, decagonal, etc. In accordance with some embodiments, the first notch Nc may be approximately W inch, where the second notch Nd may be approximately 5/16 inch. Notches Ne and Nf in the second wrenching head 50''' may 1/4 and 5/16 respectively, but preferably are different. For example, notches Ne and Nf may take on any available shapes and size know to the skilled person. For example, the notches may 1/8 inch, 3/16 inch, 1/2 inch, 5/16 inch, 3/8 inch, 7/16, inch, 1/2 inch, 9/16 inch, 5/8 inch, 11/16 inch, 3/4 inch, 13/16 inch, 7/8 inch, 15/16 inch, etc. and the like.

In accordance with some embodiments, the elongated handle 20, 20', 20", 20''' and 20'''', preferably include a plurality of finger grip indents formed in a rear surface of the proximal end 30, 30', 30", 30'''. In some aspects, the elongated handles can include a plurality of finger grip indents formed in a rear surface of the distal end, in some aspects, the elongated handle includes a plurality of finger indents formed in a rear surface of the proximal end as well as a plurality of finger grip indents formed in a rear surface of the distal end. In some aspects, a rubber sleeve may be positioned on the elongated handle. For that matter, the plurality of finger grip indents may be disposed on the rubber sleeve on the elongated handle.

Figure 5:
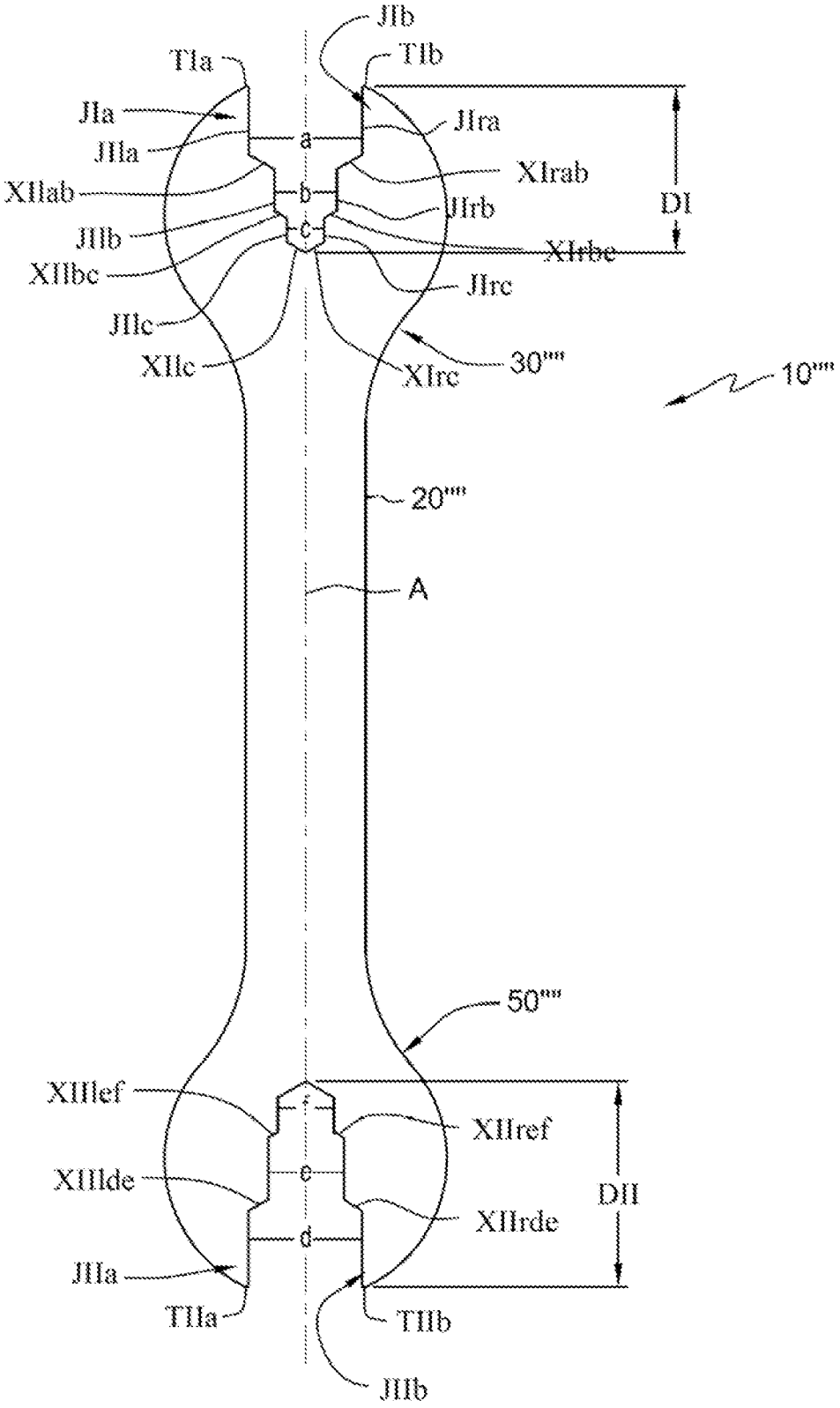
FIG. 5 is a plan view of an alternative embodiment of the FIG. 1 multiple use, open-end wrench.

FIG. 5 presents a fifth embodiment of the invention, which is a multiple use open-end wrench 10'''' adapted for use with hexagonal fasteners (also referred to as hex nuts, hex nut fasteners or hexagonal nut fasteners interchangeably herein), hex bolt heads, etc. (see description of various types of square nut fasteners above). Open-end wrench 10'''' includes an elongated handle 20'''' having a proximal end and a distal end. The elongated handle 20'''' has a longitudinal axis A, extending between the proximal and distal ends. The proximal end is configured as a first, multiple use wrenching head 30'''', with an opening between first JIa and second JIb opposing stationary jaws formed into opening portions adapted to receive decreasingly smaller sized hex fasteners for turning, as a function of distance from the jaw tips. That is, the opening of wrenching head 10'''' extends from outermost tips TIa and TIb for an aggregate depth DI, comprising 3, decreasingly sized opening portions, adapted for use with three (3) different sized hex-shaped fasteners, such as hex nuts. The exemplary FIG. 5 embodiment is adapted to accommodate a 9/16 hex nut in the first, largest opening portion of the wrenching head, a 1/2 inch hex nut in the second, smaller opening portion and a 7/16 inch hex nut in the third smallest opening portion. The person of ordinary skill in the art should understand that the sizes are arbitrarily chosen to exemplify the inventive wrench, but are not meant to be limitation in any way by size, or the number of openings.

The first largest opening portion (formed to accommodate a 9/16 inch hex nut) is bound or defined by jaw sets JIla, JIra and transitions XIlab, XIrab. The second, smaller opening portion (formed to accommodate a 1/2 inch hex nut) is bound or defined by jaw sets JIlb, JIrb and transitions XIlbc, XIrbc. The third, smallest opening portion (formed to accommodate a 7/16 inch hex nut) is bound or defined by jaw sets JIlc, JIrc and transitions XIlc, XIrc, as shown. The 9/16 hex fastener, which is the largest, can only be seated in the first, largest opening portion, as it is too large to gain entry to the second smaller and third smallest opening portions. The second 1/2 inch hex nut is too small to seat properly in the first opening portion, and too large to fit into the third, smallest opening portion.

Figure 6:
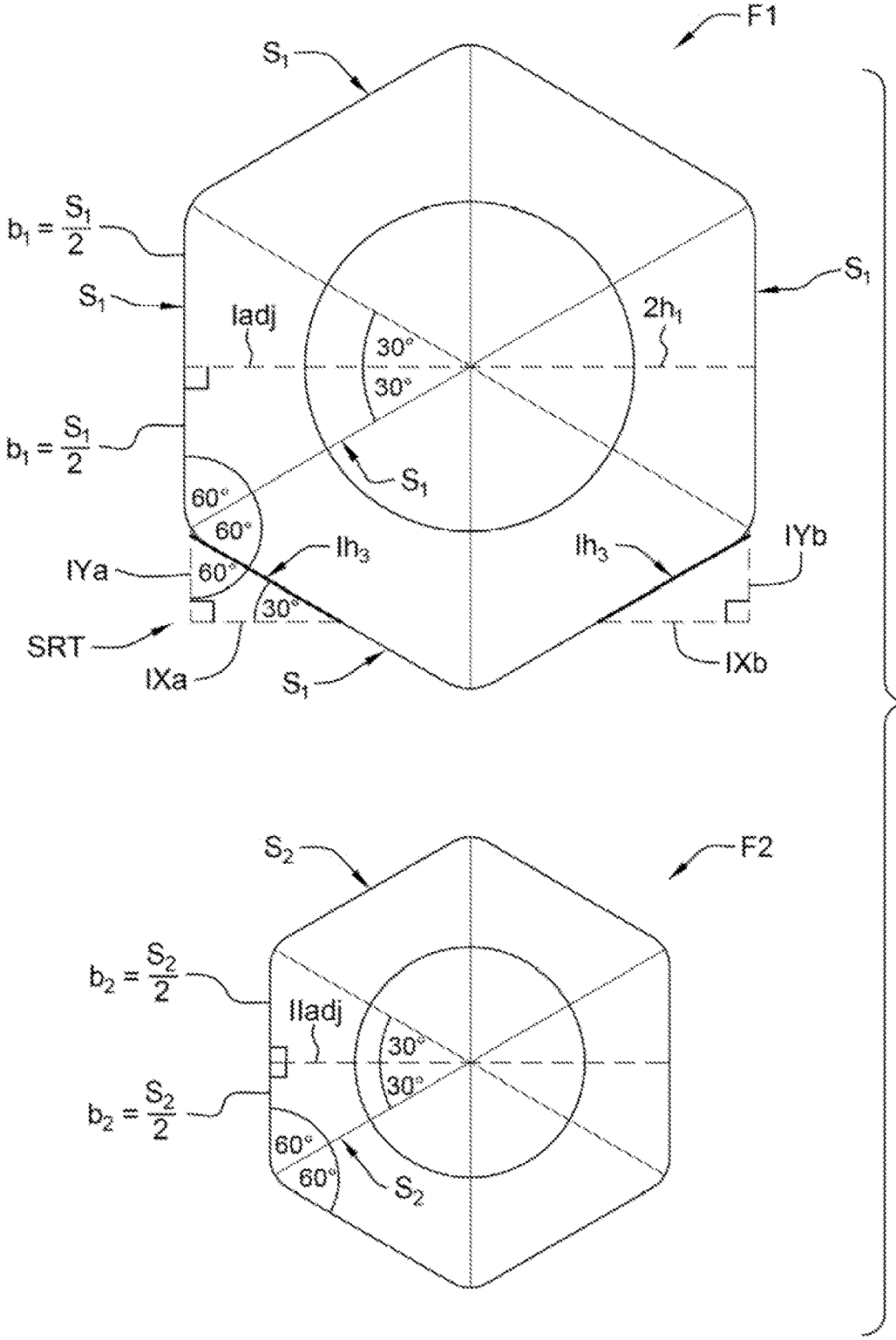
FIG. 6 is a plan view of exemplary hexagonal fasteners F1, F2 to highlight the geometric relationship defining a required transition between the respective opening portions sufficient to accommodate a portion of F1 below the opposing parallel sides, when F1 is seated in the first opening.

The aggregate depth of the first, second and third opening portions of first, proximal end wrenching head 30'''' and the second, distal end wrenching head 50'''', are equal to DI and DII, respectively, as shown. However, calculating the aggregate depth of the openings of the first and second wrenching heads 30'''' and 50'''' is more complicated than calculating the size of the openings adapted to receive square nuts. This is because the opening portions are formed to accommodate hex nuts (a largest F1 and smaller F2 of which are depicted in FIG. 6), the geometries of which are substantially equivalent to the geometries of the respective opening portions (of the first and second wrenching heads 30'''', 50''''). As explained above, the dimensions of the opening portions are slightly larger (e.g., 1-5%, preferably 2%) so that the hex nuts can fit therein, as were the respective geometries exact, they hex nuts could not enter, and if the openings were too relatively larger with respect to the size of the hex nuts, the hex nuts would not seat snugly, which could affect an ability to hold same seated while turning.

Figure 7:
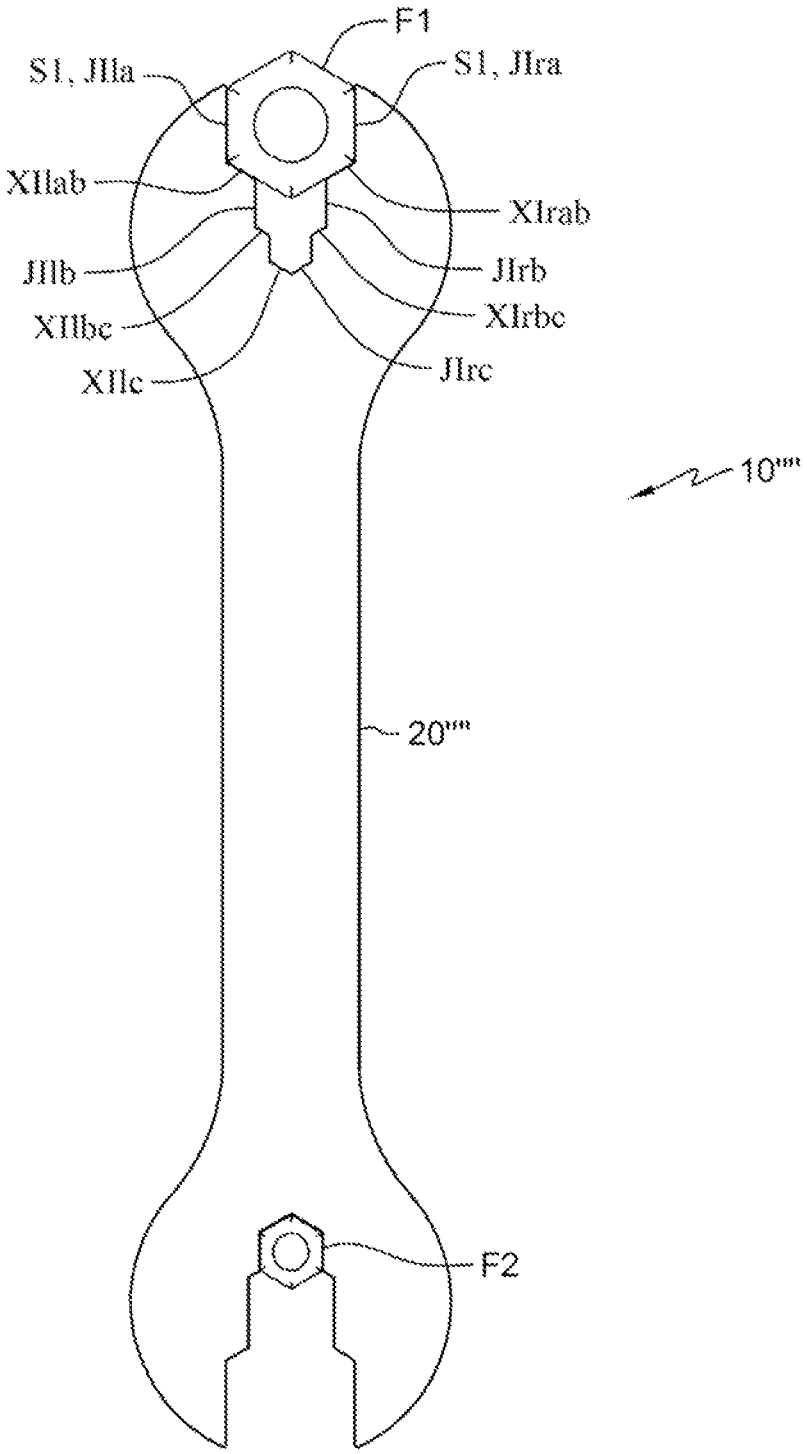
FIG. 7 is a plan view of the inventive wrench of FIG. 5 loaded with two hex fasteners at the opposing wrench heads, for exemplary purposes.

While the respective depths or lengths of the jaw set surfaces of the respective first, second and third opening portions (JIla, JIra; JIlb, JIrb; JIlc, JIrc) are substantially equivalent to the length of the 6 parallel surfaces of each of three corresponding hex nuts (parallel surfaces $S_1$, $S_2$ of 2 hex nuts F1 and F2 depicted in FIG. 6), the distances therebetween are 2 times the cosine of 30 degrees times the lengths of the sides (for example, $S_1$ (FIG. 6) is substantially equivalent to the length of opposing parallel jaw surfaces JIla and JIra) of the largest opening portion (see also FIG. 7).

A hex nut may be thought of as comprising 6 virtual equilateral triangles arranged so that the 6 respective peaks meet at the center of the hex shape of the hex nuts, as shown in FIG. 6. The distance between opposing parallel sides $S_1$ and $S_2$ of the hex nuts F1, F2, (and slightly larger opposing jaw surfaces of respective jaw sets accommodating each side $S_1$, $S_2$ of each respective hex nut F1, F2), is equal twice the length of the adjacent sides of right triangles drawn to bisect each of the six equilateral triangles, as shown.

Relying on SohCahToa, and that the hypotenuse lengths of the 6 respective equilateral triangles of hex nuts F1, F2, are equal to the parallel sides $S_1$, $S_2$ (and substantially equivalent to the slightly larger surfaces JIla and JIra; and JIlb and JIrb, respectively). The adjacent side (Iadj) of the right triangle is the cosine 30 degrees times the hypotenuse ($S_1$). Cosine 30 degrees is equal to square root 3 over 2, so the adjacent side of the right triangle is $(((3)^{1/2})/2)S_1$. The length of the bases of the right triangles are $S_1/2$, and the length of the hypotenuse are $S_1$. And as explained, the parallel distance between sides $S_1$ of any of the opposing pairs of equilateral triangles making up the shape of the hex nut fastener, is two times the adjacent side (Iadj), or $2((3)^{1/2})/2)S_1=((3)^{1/2})S_1$.

The same principle or algorithm applies to any hex nut, such as the smaller hex nut F2 with opposing parallel sides $S_2$, as shown. That is, for fastener F2, the fastener's virtual equilateral triangles between opposing hex surfaces may be bisected laterally, creating 4 right triangles, as shown in FIG. 6. The lengths of the bases are $S_2/2$, and the lengths of the hypotenuses are $S_2$. Then the distance between the opposing parallel surfaces $S_2$ are 2 times the adjacent side (IIadj) of the right triangles. This is 2 times the length of $S_2$ multiplied by cos 30 degrees, or 2 $(S_2)$(cos 30), or $S_2(3^{11})$.

The minimal transitions XIlab, XIlbc, and XIlc, which are required to accommodate the part of the hex nuts F1, F2, below the extent of the parallel sides (FIG. 6) is some portion of the extent of the sides $S_1$ for F1, and $S_2$ for F2. These extents can be said to be equivalent to hypotenuses of small right triangles (SRT), with a horizontal extent IXa that is equal to the difference between the adjacent sides (Iadj) of the right triangles of the larger and smaller hex nuts (F1, F2) created by bisecting each equilateral triangle, as explained above. Hence, the horizontal component of the right triangle of which the hypotenuse Ih3 is the transition, is Iadj−IIadj. The vertical component of SRT is the difference between the size of the bases of the respective right triangles bisecting the equilateral triangles in F1 and F2, or b1−b2.

Hence, the hypotenuse is (Iadj−IIadj)/(Cos 30 degrees), or 2(Iadj−IIadj)/$(3^{1/2})$, or 2(Iadj−IIadj)$(3^{-1/2})$. But the hypotenuse also can be calculated as the square root of the sum of the vertical component squared, and the horizontal component squared. This is $((b1-b2)^2+(Iadj-IIadj)^2)^{1/2}$.

To derive the diagonal extent of the transition (XIlab and XIlbc in FIG. 5 and Ih3 in FIG. 6, which applies as well to the second, smaller opening in wrenching head 30*iv* in FIG. 5 and F2 in FIG. 6), one may start with the difference between the distances between opposing surfaces S1, of fastener F1, and opposing surfaces S2, of fastener S2. This difference is the horizontal component IXa of the diagonal extent (hypotenuse Ih3), which is 2×Iadj−IIadj, or $2\times(S1(3^{1/2})-S2(3^{1/2}))$. The actual horizontal component is half that, or $S1(3^{1/2})-S2(3^{1/2})$. Once the horizontal component IXa is calculated, the hypotenuse Ih3 is cos 30 (Iadj−IIadj), or Cos $30\times(S1(3^{1/2})-S2(3^{1/2}))$. From the hypotenuse Ih3 of the transition, the vertical component IYa is calculated as sin 30×hypotenuse, or sin 30×(cos 30 (Iadj−Iadj)), or $(3^{1/2})/4$ (Iadj−IIadj). The remainder of the extent of the surface S1 upon which the diagonal extent or hypotenuse Ih3 is superimposed, has sufficient space in the opening portion adapted to accommodate fastener F2. The last transition, XIlc, XIrc (FIG. 5) is slightly larger than the full length of the side of the third hex nut (not shown in FIG. 6).

Returning to FIG. 5, wrench 10"" also includes a second, multiple use wrenching head 50"" with three (3) jaw sets adapted for use with three (3) decreasingly smaller sized hex-shaped opening portions for accommodating 3 decreasingly-sized hex-shaped fasteners, for example, ⅜ inch (jaws JIIld, JIIrd), 5⁄16 inch (jaws JIIle, JIIre) and ¼ inch (jaws JIIlf, JIIrf), as shown. The largest sized nut (⅜ inch) can only be seated in the opening portion formed by the first set of jaws (JIIld, JIIrd), which is ⅜ inch×$(3^{1/2})$ therebetween. No larger fastener can be received therein. While smaller fasteners, such as the 5⁄16 inch, ¼ inch and even smaller size faces/surfaces, like 3⁄16, ⅛, 1⁄16, etc., only a ⅜ inch will properly seat in the opening portion of the first set of jaws (JIIld, JIIrd).

Likewise, the 5⁄16 inch hex fastener will not seat in the opening portion of the first set of jaws (JIIld, JIIrd), but only in the opening portion of the second set of jaws (JIIle, JIIre); the 5⁄16 inch hex fastener cannot move further in past the second opening portion formed by jaw surfaces (JIIle, JIIre) because the fastener faces/surfaces are 5⁄16 inch, and the separation between the third set of jaw surfaces (JIIlf, JIIrf) is ¼ inch×$(3^{1/2})$. Moreover, the ¼ inch×¾ inch hex fastener or bolt head cannot be seated in the second opening portion, which is a 5⁄16×$(3^{1/2})$ inch opening portion.

Please note that while the FIG. 5 embodiment shows the inventive open-end wrench 10 formed with first and second wrenching heads formed with three (3) jaw sets for receiving the three (3) hex-shaped fasteners sized ⅜, 5⁄16 and ¼ inches, the inventive multiple use open-end wrench is not limited thereto. The inventive open-end wrench may be formed with wrenching heads comprising the same number, or different numbers of jaw sets, such as 2, 3, 4, 5, etc., without deviating from the scope or spirit of the invention. For that matter, the three jaw sets in the exemplary embodiment is not limited to ⅜ inch, 5⁄16 inch, ¼ inch, but could be any required open-end wrench sizes, for example, 1 inch, ¾ inch, ½ inch, or ¼ inch, 31⁄32 inch and 15⁄16 inch, or 1⁄10 inch, 3⁄40, 1⁄20, or 5⁄2 inch, 9⁄4 inch, 2 inch, 3 inch, 4 inch, 5 inch, 6 inch, etc., without deviating from the scope or spirit of the invention. The "d," "e," or "f" fasteners (and corresponding opening portions of the wrench head), with the respective jaw sizes, are always largest to smallest, because the smaller sized nuts or bolt heads have to get past the first jaw surfaces defining the first largest opening portion, to get to the second, smaller opening portion or the third smallest opening portion.

From the foregoing and with reference to the various figure drawings, those skilled in the art will appreciate that certain modifications can also be made to the disclosure without departing from the scope of the same. While several embodiments of the disclosure have been shown in the drawings, it is not intended that the disclosure be limited thereto, as it is intended that the disclosure be as broad in scope as the art will allow and that the specification be read likewise.

Therefore, the above description should not be construed as limiting, but merely as exemplifications of particular embodiments. Those skilled in the art will envision other modifications within the scope and spirit of the claims appended hereto.

What is claimed is:

1. A multiple use open-end wrench, comprising:

an elongate handle having a proximal end, an opposing distal end and a longitudinal axis extending therebetween; and a wrenching head arranged at the proximal end of the elongated handle formed with an opening for receiving and turning a plurality of varying sized hexagonal fasteners, where the opening includes opposing left and right jaws with respective opposing, parallel left and right jaw surfaces, and extends from an end tip of the proximal end substantially in parallel with the respective opposing, parallel left and right jaw surfaces, where a distance between the opposing parallel left and right jaw surfaces defines sizes of a plurality of opening portions of the opening that correspond to sizes of a plurality of the varying sized fasteners, for seating and turning within the respective opening portions; and diagonal transitions extending from a vertical end of each opposing parallel jaw surfaces of each adjacent opening portion, the diagonal transitions having a vertical component and a horizontal component, wherein the horizontal component is equal to or greater than a difference between the one half of respective distances between the respective jaw surfaces of the adjacent different size opening portions.

2. The multiple use open-end wrench of claim 1, wherein the vertical component of the transition is equal to or greater than a difference between a size of the parallel opposing jaw surfaces of a larger opening portion and a smaller opening portion of the two adjacent opening portions.

3. The multiple use open-end wrench of claim 2, wherein the lengths of the opposing parallel jaw surfaces of the opening portions, and the length of the diagonal transitions, are at least 2 percent larger than surfaces of hexagonal nuts for which the opening portions are sized.

4. The multiple use open-end wrench of claim 1, wherein the elongated handle includes a plurality of finger grip indents for gripping.

5. The multiple use open-end wrench of claim 1, wherein the wrenching head includes at least one notch on an outer surface, the at least one notch configured for receiving and turning a shaped fastener.

6. The multiple use open-end wrench of claim 1, wherein a diagonal transition of a smallest opening portion of the opening, which is furthest in distance from the tip end, is substantially equal to a length of the opposing parallel jaw surfaces.

7. The multiple use open-end wrench of claim 1, wherein the wrenching head is a first wrenching head, and wherein the wrench further comprises:

a second wrenching at a distal end of the elongated handle formed with an opening for receiving and turning a plurality of varying sized hexagonal fasteners, where the opening includes opposing left and right jaws with respective opposing, parallel left and right jaw surfaces, and extends from an end tip of the distal end substantially in parallel with the respective opposing, parallel left and right jaw surfaces, where a distance between the opposing parallel left and right jaw surfaces defines sizes of a plurality of opening portions of the opening that correspond to sizes of a plurality of the varying sized fasteners, for seating and turning within the respective opening portions of the second wrenching head.

8. The multiple use open-end wrench of claim 7, wherein the second wrenching head includes diagonal transitions extending from a vertical end of each opposing parallel jaw surfaces of each adjacent opening portion, the diagonal transitions having a vertical component and a horizontal component;

wherein the horizontal component is equal to or greater than a difference between the one half of respective distances between the respective jaw surfaces of the adjacent different size opening portions.

9. The multiple use open-end wrench of claim 8, wherein the vertical component of the transition is equal to or greater than a difference between a size of the parallel opposing jaw surfaces of a larger opening portion and a smaller opening portion of the two adjacent opening portions.

10. The multiple use open-end wrench of claim 9, wherein a length of the diagonal transition is equal to the square root of the square of the vertical component and the square of the horizontal component.

11. A multiple use open-end wrench, comprising:

an elongate handle having a proximal end, an opposing distal end and a longitudinal axis extending therebetween; and a wrenching head arranged at the proximal end of the elongated handle formed with an opening for receiving and turning a plurality of varying sized hexagonal fasteners, where the opening includes opposing left and right jaws with respective opposing, parallel left and right jaw surfaces, and extends from an end tip of the proximal end substantially in parallel with the respective opposing, parallel left and right jaw surfaces, where a distance between the opposing parallel left and right jaw surfaces defines sizes of a plurality of opening portions of the opening that correspond to sizes of a plurality of the varying sized fasteners, for seating and turning within the respective opening portions; and diagonal transitions extending from a vertical end of each opposing parallel jaw surfaces of each adjacent opening portion, the diagonal transitions having a vertical component and a horizontal component, wherein the horizontal component is equal to or greater than a difference between the one half of respective distances between the respective jaw surfaces of the adjacent different size opening portions, wherein the vertical component of the transition is equal to or greater than a difference between a size of the parallel opposing law surfaces of a larger opening portion and a smaller opening portion of the two adjacent opening portions, and wherein a length of the diagonal transition is equal to the square root of the square of the vertical component and the square of the horizontal component.

* * * * *